US012207684B2

(12) United States Patent
Ruscio et al.

(10) Patent No.: US 12,207,684 B2
(45) Date of Patent: Jan. 28, 2025

(54) AEROSOL-GENERATING DEVICE WITH A REMOVABLY-INSERTABLE RESIDUE COLLECTOR

(71) Applicant: Philip Morris Products S.A., Neuchatel (CH)

(72) Inventors: Dani Ruscio, Neuchatel (CH); Keethan Dasnavis Fernando, Neuchatel (CH); Boris Mahler, Neuchatel (CH); Elmar Peter Mock, Biel/Bienne (CH); Antonino Lanci, Biel/Bienne (CH); Philipp Bernhard, Biel/Bienne (CH); Naomi Bitmead, Biel/Bienne (CH); Mario Tronza, Biel/Bienne (CH)

(73) Assignee: Philip Morris Products S.A., Neuchatel (CH)

( * ) Notice: Subject to any disclaimer, the term of this patent is extended or adjusted under 35 U.S.C. 154(b) by 1239 days.

(21) Appl. No.: 16/956,157

(22) PCT Filed: Dec. 18, 2018

(86) PCT No.: PCT/EP2018/085687
§ 371 (c)(1),
(2) Date: Jun. 19, 2020

(87) PCT Pub. No.: WO2019/121811
PCT Pub. Date: Jun. 27, 2019

(65) Prior Publication Data

US 2021/0112878 A1 Apr. 22, 2021

(30) Foreign Application Priority Data

Dec. 22, 2017 (EP) ..... 17210380

(51) Int. Cl.
*A24F 40/46* (2020.01)
*A24F 40/85* (2020.01)
*A24F 40/20* (2020.01)

(52) U.S. Cl.
CPC ..... *A24F 40/46* (2020.01); *A24F 40/85* (2020.01); *A24F 40/20* (2020.01)

(58) Field of Classification Search
None
See application file for complete search history.

(56) References Cited

U.S. PATENT DOCUMENTS 2,419,509 A 4/1947 Turner
4,235,252 A 11/1980 Bianchino
(Continued)

FOREIGN PATENT DOCUMENTS

CA 2 252 198 A1 5/2000
CN 1942114 A 4/2007
(Continued)

OTHER PUBLICATIONS

International Search Report and Written Opinion issued Apr. 2, 2019 in PCT/EP2018/085687 filed on Dec. 18, 2018.
(Continued)

*Primary Examiner* — Dionne W. Mayes
(74) *Attorney, Agent, or Firm* — Oblon, McClelland, Maier & Neustadt, L.L.P.

(57) ABSTRACT

An aerosol-generating system is provided, including an aerosol-generating device having a heating chamber configured to heat an aerosol-forming substrate, the heating chamber including a first end having an opening, a second end having a base, and a side wall extending between the opening and the base; and a residue collector removably insertable into the heating chamber and positionable at or near the second end, the heating chamber further including
(Continued)

a first side opening in the side wall and a second side opening in the side wall, opposite the first side opening, and the residue collector being insertable into the heating chamber and removable from the heating chamber through the first and the second side openings.

12 Claims, 5 Drawing Sheets

(56) References Cited

U.S. PATENT DOCUMENTS

| | | | |
|---|---|---|---|
| 4,328,795 | A | 5/1982 | Cabaniss, III |
| 2004/0149737 | A1 | 8/2004 | Sharpe et al. |
| 2009/0007926 | A1 | 1/2009 | Gidding |
| 2010/0275937 | A1 | 11/2010 | Shakouri Moghadam |
| 2015/0013696 | A1* | 1/2015 | Plojoux et al. ..... A61M 15/06 131/328 |
| 2018/0049472 | A1 | 2/2018 | Mahler et al. |

FOREIGN PATENT DOCUMENTS

| | | | |
|---|---|---|---|
| CN | 101133185 | A | 2/2008 |
| CN | 105722416 | A | 6/2016 |
| CN | 205728067 | U | 11/2016 |
| CN | 106535680 | A | 3/2017 |
| CN | 107205494 | A | 9/2017 |
| JP | 2009-521950 | A | 6/2009 |
| JP | 2015-504670 | A | 2/2015 |
| JP | 2018-504134 | A | 2/2018 |
| KR | 10-2017-0115492 | A | 10/2017 |
| RU | 2 389 419 | C2 | 2/2010 |
| WO | WO 2007/078197 | A2 | 7/2007 |
| WO | WO 2013/102614 | A2 | 7/2013 |
| WO | WO 2016/124550 | A1 | 8/2016 |
| WO | WO 2017/079453 | A1 | 5/2017 |

OTHER PUBLICATIONS

Russian Federation Office Action issued Dec. 1, 2021 in Russian Federation Patent Application No. 2020124109/03(041629) (with English translation), 18 pages.

Combined Chinese Office Action and Search Report issued on Feb. 8, 2023 in Chinese Patent Application No. 201880077306.3 (with English translation), 13 pages.

Japanese Office Action issued on Jan. 4, 2023 in Japanese Patent Application No. 2020-532682 (with English translation), 5 pages.

Korean Notice4 of Allowance issued May 1, 2024 in Korean Patent Application No. 10-2020-7015725 (with English Translation), 4 pages.

* cited by examiner

AEROSOL-GENERATING DEVICE WITH A REMOVABLY-INSERTABLE RESIDUE COLLECTOR

The present invention relates to an aerosol-generating system for heating aerosol-generating articles to form an inhalable aerosol. In particular, the invention relates to systems that include a removably-insertable residue collector. The residue collector is configured to be positioned at or near a base of a heating chamber of the aerosol-generating system.

Devices for generating aerosols for inhalation by a user are known in the art. Such devices typically include a heating chamber to receive an aerosol-generating article comprising an aerosol-forming substrate. Such devices typically also include a heater assembly configured to heat the aerosol-forming substrate within the heating chamber in order to generate the inhalable aerosol. For example, WO2013/102614 discloses an aerosol-generating device comprising a heating chamber for receiving an aerosol-generating article comprising a solid aerosol-forming substrate. In use, the aerosol-generating article is inserted into the heating chamber and impaled on a heater that is disposed within the chamber. The heater can be activated to heat the aerosol-forming substrate and generate an aerosol. After consumption, the aerosol-generating article is removed from the device and discarded.

Insertion, removal and heating of aerosol-forming substrates in such an aerosol-generating device typically creates residues, such as loose debris, within the heating chamber. Residue from the heating process may accumulate on heaters, in particular on internal heaters that penetrate into the substrate. Residue may also accumulate on inner walls of the heating chamber. Particles or pieces of aerosol-forming substrate from the aerosol-generating article may come loose and be released into the heating chamber when the aerosol-forming substrate is inserted into the heating chamber or removed from the heating chamber. These forms of debris may accumulate within the heating chamber over time and multiple uses of the device. In particular, debris may accumulate around the base or closed end of the heating chamber. If there is an internal heater, debris may also accumulate around the base of the heater. Accumulated debris may hinder the effective operation of the device, for example by absorbing some of the heat from the heater that is intended for heating of the aerosol-forming substrate, or by affecting airflow through the device, or by inhibiting insertion and removal of aerosol-generating articles.

The heating chamber of an aerosol-generating device is typically sized and shaped to closely accommodate an aerosol-generating article. Thus, for example, a heating chamber for accommodating an aerosol-generating article shaped like a traditional cigarette may be a cylindrical heating chamber having dimensions slightly larger than the external dimensions of the article. It is typically desirable to clean the heating chamber of an aerosol-generating device between uses to minimise the build-up of residue and debris. It is known to provide a brush with aerosol-generating systems that can be inserted into the heating chamber between uses to dislodge and remove accumulated residue. However, due to the typically small size of a heating chamber in an aerosol-generating system, and the presence of corners within the heating chamber that are difficult to access, the use of a brush may not be completely effective at removing accumulated residue.

In an aspect of the invention, there is provided an aerosol-generating system comprises an aerosol-generating device having a heating chamber for heating an aerosol-forming substrate. The heating chamber comprises a first end having an opening, a second end having a base, and a side wall extending between the opening and the base. The aerosol-generating system further comprises a residue collector that is removably-insertable into the heating chamber and positionable at or near the second end.

Typically, the side wall of the heating chamber may extend from the periphery of the base. The side wall may extend around substantially the entire circumference of the base. The side wall may extend in a direction substantially perpendicular to the base. As used herein, the term 'perpendicular' relates to a substantially orthogonal relative orientation of two parts of the device or system, such as the relative orientation between the base and the side wall of the heating chamber. The side wall extends away from the base to define the cavity of the heating chamber. The side wall may extend from the periphery of the base, around the entire periphery of the base, in a direction substantially perpendicular to the base, thereby forming a substantially cylindrical tube. Where the base is substantially circular, the heating chamber may form a substantially right circular cylindrical tube. The end or termination of the side wall opposite the base may provide or define the opening at the first end of the heating chamber. In this arrangement, the heating chamber may be configured to receive a portion of an aerosol-generating article that resembles a conventional cigarette.

The heating chamber of the present invention has at least one side wall. Where the heating chamber has a single side wall, the side wall may extend substantially around the circumference of the base. Where the heating chamber has more than one side wall, the side walls may be arranged to extend substantially around the circumference of the base. The heating chamber may have any suitable number of side walls. It will be appreciated that references to features of heating chambers having a single side wall apply equally to heating chambers having more than one side wall.

In some embodiments, the side wall may be physically connected to the base. In some embodiments, the base may be separable from the side wall. As used herein, the term 'corner' refers to a region where two surfaces meet, for example the region where a side wall meets a base, or a region where a base meets a surface of a heater. A typical corner in a heating chamber may form an angle of substantially 90 degrees between a base and a side wall extending perpendicularly from the base.

Generally, residue from the aerosol-forming substrate received in the heating chamber may accumulate at the base. In particular, in embodiments comprising an internal heater extending into the heating chamber through the base, residue may accumulate at the base at or around the heater. The residue collector may be positioned within the heating chamber such that the majority of residue from the aerosol-forming substrate accumulates on the collector rather than on elements of the heating chamber. When the residue collector is removed from the heating chamber, the residue that has collected on it may also be removed. This reduces the amount of residue within the heating chamber that requires cleaning.

The residue collector may be configured to be positioned between the base of the heating chamber and an aerosol-forming substrate received in the heating chamber. In this position, residue from the aerosol-forming substrate that would otherwise accumulate on the base of the heating chamber may accumulate on the residue collector instead. The residue collector may be seated on the base of the heating chamber.

The residue collector may directly abut the base of the heating chamber. The residue collector may indirectly contact the base of the heating chamber. The residue collector may substantially cover the base of the heating chamber. In this position, the residue collector may protect substantially the entire base from residue from the aerosol-forming substrate. The residue collector may abut the side wall of the heating chamber. The residue collector may abut the side wall of the heating chamber around substantially the entire periphery of the residue collector.

The residue collector may be removably-insertable through the opening of the heating chamber. This configuration may allow the heating chamber to have a single opening. Aerosol-forming substrate may be inserted through the same opening as the residue collector. This makes for simpler construction of the heating chamber. Additionally, this limits user access to the heating chamber to a single open end, and any heater extending into the heating chamber may be positioned distal to the open end. This may reduce the risk of damaging the heater and may reduce the likelihood of a user coming into contact with the heater.

The heating chamber may further comprise a side opening in the side wall, and the residue collector may be removable from the heating chamber and insertable into the heating chamber through the side opening. The side opening in the heating chamber may be configured specifically for use with the residue collector. The size and shape of the side opening may be configured to allow insertion and removal of the residue collector only. Unwanted objects with dimensions different to the residue collector may be substantially prevented from entering the heating chamber through the side opening. The residue collector may cover, fill or plug the side opening once inserted into the heating chamber. A side wall of the residue collector may be flush with the outer surface of the side wall when the residue collector is fully inserted into the heating chamber. If the residue collector does not extend out of the heating chamber through the side opening, beyond the outer surface of the side wall of the heating chamber, when the residue collector is fully inserted into the heating chamber, the residue collector may be substantially protected within the heating chamber. The side opening may be positioned adjacent the base of the heating chamber. The residue collector may be inserted into the side opening and be positioned on the base of the heating chamber. Positioning the opening adjacent to the second end of the heating chamber may reduce, minimise or substantially eliminate the longitudinal distance the base must be moved within the heating chamber when it is being inserted.

The heating chamber may further comprise a first side opening in the side wall and a second side opening in a side wall, opposite the first side opening. The residue collector may be removable from the heating chamber and insertable into the heating chamber through the first and second side openings. In these embodiments, removal of the residue collector from the heating chamber through the first side opening may be achieved by insertion of a second residue collector through the second side opening, opposite the first side opening. Similarly, removal of the residue collector from the heating chamber through the second side opening may be achieved by insertion of a second residue collector through the first side opening. A stop or abutment may be provided within the heating chamber or at or around the first side opening to prevent a residue collector inserted through the first side opening from being removed from the heating chamber through the second side opening. Similarly, a stop or abutment may be provided within the heating chamber or at or around the second side opening to prevent a residue collector inserted through the second side opening from being removed from the heating chamber through the first side opening. This may prevent residue collectors inserted into the heating chamber through one of the side openings form being pushed out of the heating chamber during insertion. In some embodiments, the stop or abutment may be formed by a heater extending into the heating chamber. For removal of a residue collector from the heating chamber where such stops or abutments are provided, a second residue collector may be inserted through the opposite side opening, and in doing so pushing the residue collector out of the side opening through which it was inserted. For example, a residue collector inserted through the first side opening may be removed from the heating chamber through the first side opening by inserting a second residue collector into the heating chamber through the second side opening.

The residue collector may occupy a small proportion of the space within the heating chamber. The residue collector may not interfere with the generating or aerosol from the aerosol-forming substrate received in the heating chamber.

In a preferred embodiment, there is provided an aerosol-generating system comprises an aerosol-generating device having a heating chamber for heating an aerosol-forming substrate. The heating chamber comprises a first end having an opening, a second end having a base, and a side wall extending between the opening and the base. The aerosol-generating system further comprises a residue collector that is removably-insertable into the heating chamber and positionable at or near the second end. The heating chamber further comprises a first side opening in the side wall and a second side opening in the side wall, opposite the first side opening. The residue collector is insertable into the heating chamber and removable from the heating chamber through the first and second side openings.

The residue collector may comprise a body defined between a first face and a second face. The first face may be substantially planar. The second face may be substantially planar. The shape and size of the first and second faces may be substantially the same. The residue collector may have a substantially constant transverse cross-section between the first and second faces. In other words, the shape and size of the transverse cross-section of the residue collector may be substantially constant along the height or thickness of the residue collector, between the first face and the second face.

The first and second faces may have any suitable shape. For example, the first and second faces may have a rounded rectangular, circular, elliptical or rectangular shape. Typically, the first and second faces may have substantially the same shape. However, the first and second faces may have different shapes. The size and shape of the first and second faces may be complimentary to the size and shape of the heating chamber. In some embodiments, the first and second faces may have the same size and shape as the base of the heating chamber.

The residue collector may have any suitable height or thickness. In some embodiments, the residue collector may be thin. In other words, the residue collector may have a thickness or height between the first face and the second face that is substantially smaller than the dimensions of the first face and the second face. The residue collector may be thin, such that the residue collector does not substantially project into the heating chamber. A thin residue collector may be a plate or a sheet. A thin residue collector may be required to be rigid so that the residue collector does not deform or break during insertion and removal.

In some embodiments, the residue collector may have a substantial thickness between the first face and the second face. The residue collector may be substantially cuboidal. When the residue collector is positioned within the heating chamber, the second face may be positioned adjacent the base of the heating chamber. The residue collector may be supported by the base of the heating chamber. The second face of the residue collector may act as a base of the residue collector. The second face of the residue collector may comprise feet or a lip that space the second face of the residue collector from the base. This may reduce the friction between the base and the residue collector during insertion and removal. When the residue collector is positioned within the heating chamber, the first face may be directed towards the first, open end of the heating chamber, and as such, towards any aerosol-generating article within the heating chamber. In this position, the first face may be configured to abut the distal end of an aerosol-forming substrate or aerosol-generating article received in the heating chamber. The first face of the residue collector may be arranged to catch or intercept debris released from the aerosol-forming substrate or the aerosol-generating article.

The residue collector may comprise a slot extending between the first face and the second face. The slot may be configured to receive a heater extending into the heating chamber. When the residue collector is positioned within the heating chamber, and a heater is received in the slot, the first face of the residue collector may substantially circumscribe or surround the heater at the distal or second end of the heater. In particular, the first face of the collector may extend close to the heater or may abut the heater around the circumference of the heater. In this configuration, the residue collector may collect debris from around the heater and substantially prevent or inhibit debris from passing between the heater and the residue collector to the base of the heating chamber.

The slot may be arranged at any suitable location in the body of the residue collector. Typically, the slot is positioned to receive a heater extending into the heating chamber. In some embodiments, a heater extends centrally into the heating chamber from the base. In these embodiments, the slot may be located centrally in the body of the residue collector.

In some embodiments, the slot may be a closed slot. In other words, the slot may be open at the first and second faces but may not open at the side wall of the residue collector. In these embodiments, the residue collector may be inserted through the open end of the heating chamber, and the top end of the heater may penetrate the slot in the residue collector. In some embodiments, as the residue collector is inserted into the heating chamber, the residue collector may be pushed over the heater and along its length, with the heater passing through the slot, until the residue collector reaches the base of the heating chamber.

In some embodiments, the slot may be an open slot. In other words, the slot may be open at the first and second faces and also open at the side wall of the residue collector. An open slot may enable a heater to be inserted into the slot through a side of the residue collector. The slot may be configured to extend from one side of the residue collector towards the centre of the residue collector. The slot may be configured to extend from a front of the residue collector to the centre of the body of the residue collector. In these embodiments, the residue collector may be inserted through a side opening in the heating chamber. In these embodiments, as the front of the residue collector is inserted into the heating chamber, a heater within the heating chamber may be received in the slot through the opening at the side wall. In these embodiments, the residue collector may be pushed over the heater and along its width, with the heater passing through the slot, until the front of the residue collector reaches the opposite side of the heating chamber.

The edges or sides of the slot may be configured to abut the heater when the residue collector is received in the heating chamber. Where the residue collector abuts the heater, residue, such as debris, may be prevented from passing between the heater and the residue collector through the slot. The slot may form an interference fit with the heater. An interference fit may help to retain the residue collector in position during use.

The residue collector may comprise a plurality of cut-outs on each side of the slot. The cut-outs may define a plurality of projecting elements on each side of the heater. The projecting elements may project towards the heater from the residue collector. The distal ends of the projecting elements may abut the heater when the residue collector is received in the heating chamber. During removal of the reside collector from the heating chamber, the distal ends of the projecting elements may be drawn against the heater. The projecting elements may scrape or wipe the heater as they are drawn along it during removal to help to clean residue from the heater. The projecting elements may be resiliently deformable. The projecting elements may deform when the residue collector is inserted into the heating chamber and over a heater. The projecting elements may exert a force on the heater when deformed, which may help to retain the residue collector in position during use. In some embodiments, the projecting elements may facilitate removal of the residue collector from the heating chamber as the projecting elements may reduce friction between the heater and the residue collector. The projecting elements may provide additional flexibility in the residue collector around the heater, which may reduce the likelihood of deforming or damaging the residue collector and the heater during insertion and removal.

The first face of the residue collector may comprise an adhesive material. Any suitable adhesive may be used. The adhesive may cover substantially the entire first face of the residue collector. The adhesive may cover a limited section of the first face of the residue collector. The adhesive may encourage debris to stick to the residue collector, which may reduce or minimise loss of debris from the residue collector during removal of the residue collector The first face of the residue collector may comprise a lip. The lip may project upwards from the first face. The lip may extend around the periphery of the first face. The lip may be a peripheral ridge or raised edge. The lip may extend around the full periphery of the first face. The lip may extend around only a portion of the periphery of the collecting face. The lip may have any suitable shape and size. In some embodiments, the lip may be a wide lip, extending across the first face towards the centre of the residue collector to cover a large proportion of the first face. A wide lip may cover over a third of the first face. A wide lip may cover over half of the first face. In some embodiments, the lip may be a narrow lip. A narrow lip may cover less than 10% of the first face. A narrow lip may cover less than 5% of the first face. The lip may prevent debris from falling off the side of the collecting face when the residue collector is removed. The lip may provide a larger area of contact with the side wall of the heating chamber than the edge of a residue collector with no lip.

The lip and first face may define an open cavity. The open cavity may be arranged centrally. The open cavity may be arranged at or around the slot. The open cavity may encircle a slot entirely located in a central portion of the residue collector. The open cavity may encircle the central part of a slot that extends from an edge of the residue collector. The open cavity may provide a dish or a bowl type of region in which debris can accumulate. Providing such an open cavity may recue or minimise loss of the debris accumulated on the residue collector during removal.

A plurality of projections may extend upwards from the first face. The plurality of upward projections may extend over any suitable portion of the first face. In some embodiments, the plurality of upward projections may extend over the entire first face. In embodiments comprising an open cavity defined by the first face and a lip extending from the first face, the plurality of upward projections may be located within the open cavity. The plurality of upward projections may be arranged in a regular pattern. For example, the upward projections may be arranged in a honeycomb pattern. Orifices may be formed between adjacent projections. Debris may accumulate in the orifices. The orifices may prevent debris from coming lose when the residue collectors are removed from the heating chamber.

In some embodiments, the residue collector may comprise one or more slits. The one or more slits may extend from the first face towards the second face. The one or more slits may extend between the first face and the second face. One or more slits may be provided to enable the residue collector to be deformed during insertion and removal to facilitate insertion and removal. For example, the slits may enable a user to apply an inward force to opposing sides of the residue collector to compress or reduce the width of the residue collector. The width of the slits may be chosen such that the residue collector is sufficiently compressible that it can be inserted through an opening in the heating chamber. Where the residue collector comprises a slot for receiving a heater, the residue collector may comprise slits at opposite sides of the slot. The slits may extend from the side wall of the residue collector. The slits may extend from the side wall of the residue collector towards a central region of the residue collector. In embodiments where a slot extends from the front of the residue collector, the residue collector may comprise slits at opposite sides of the slot that extend from the front of the residue collector, in a direction parallel to the slot.

The residue collector may comprises engagement means for engaging with a removal tool. The tool may be any suitable tool for removal of the residue collector from the heating chamber. The engagement means may be a notch in at least one side of the residue collector. In these embodiments, the tool may include a hook or clip to engage with the notch such that the tool can pull the residue collector from the heating chamber. The engagement means may be a magnetic portion. In these embodiments, the tool may include a magnetic portion to attract the magnetic portion on the residue collector such that the tool can pull the residue collector from the heating chamber.

Providing a removal tool and engagement means for engaging with the removal tool may reduce the need for a user to touch the residue collector during removal or insertion. This is particularly advantageous during removal when the residue collector has residue or debris accumulated on it. Additionally, the residue collector may be hot or warm to the touch after use, so the use of a tool may reduce the risk of a user coming into contact with a warm residue collector. The use of a removal tool may reduce the need for the user to wait for the residue collector to cool before removing it from the heating chamber.

The residue collector may be formed from any suitable material. For example, the residue collector may be formed from a plastic material. A suitable plastic material may be PEEK. A residue collector formed of PEEK may be reusable. A residue collector formed of PEEK may be disposable of after a single use. In some embodiments, the residue collector may be formed from a fibrous material. Suitable fibrous materials may include natural fibres such as cellulose. Fibrous materials include wood board, museumskarton, wood pulp-board, eco-wood board, Chipboard, as well as wood directly from trees such as Pine, Spruce, Beech and any other suitable species of tree. In some embodiments, cardboard may be used to form the residue collector. Cardboard is a generally lightweight and inexpensive material that is typically straightforward to discard.

The residue collector may be reusable. In embodiments comprising a reusable residue collector, the residue collector may be removed from the heating chamber and debris and residue may be cleaned from the residue collector. For example, the residue collector may be cleaned by running water over the residue collector. A reusable residue collector may be re-inserted into the heating chamber after being cleaned.

The residue collector may be disposable. The residue collector may be disposable after a single use. Advantageously, a disposable residue collector may not require cleaning after use. A disposable residue collector may be removed from the heating chamber and discarded, thereby discarding any collected debris with the residue collector. A new disposable residue collector may be inserted into the heating chamber after removal and disposal of the previous disposable residue collector.

The residue collector may be provided as part of an array of residue collectors. Adjacent or neighbouring residue collectors in the array may be releasably secured together at the side walls. For example, the residue collector may be provided as part of a strip of multiple residue collectors. Multiple residue collectors may be formed simultaneously as part of the strip. Multiple residue collectors may be stored and transported together as part of the strip. Individual residue collectors in the array may be separated by weakened portions, such as by perforations. Weakened portions, such as perforations, may allow individual residue collectors to be easily removed by a user from the rest of the array. The array of multiple residue collectors may be formed as part of a packet. The packet may be a packet for storing aerosol-generating articles.

As used herein, the term 'aerosol-forming substrate' relates to a substrate capable of releasing volatile compounds that can form an aerosol. The volatile compounds may be released by heating the aerosol-forming substrate. A suitable aerosol-forming substrate may comprise nicotine, a plant-based material, a homogenised plant-based material, or at least one aerosol-former or other additives or ingredients, such as flavourants. A suitable substrate may be in solid form, such as a tobacco plug. A tobacco plug may comprise one or more of: powder, granules, pellets, shreds, spaghettis, strips or sheets containing one or more of: tobacco leaf, fragments of tobacco ribs, reconstituted tobacco, homogenised tobacco, extruded tobacco and expanded tobacco. Optionally, the tobacco plug may contain additional tobacco or non-tobacco volatile flavour compounds, to be released upon heating of the tobacco plug.

Where the tobacco plug comprises homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may have an aerosol former content of between 5 percent and 30 percent by weight on a dry weight basis. In some embodiments, sheets of homogenised tobacco material may be formed by agglomerating particulate tobacco obtained by grinding or otherwise comminuting one or both of tobacco leaf lamina and tobacco leaf stems. In some embodiments, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, tobacco endogenous binders, one or more extrinsic binders, tobacco exogenous binders, or a combination thereof to help agglomerate the particulate tobacco. In some embodiments, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material may be formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The aerosol-forming substrate may be adsorbed, coated, impregnated or otherwise loaded onto a carrier or support.

The aerosol-forming substrate may be provided as part of an aerosol-generating article. As used herein 'aerosol-generating article' relates to an article comprising an aerosol-forming substrate. An aerosol-generating article may be a non-combustible aerosol-generating article. A non-combustible aerosol-generating article is an article comprising an aerosol-forming substrate capable of releasing volatile compounds without combustion of the aerosol-forming substrate, for example by heating the aerosol-forming substrate, by a chemical reaction or by mechanical stimulus of the aerosol-forming substrate. An aerosol-generating article may be a smoking article that generates an aerosol that is directly inhalable into a user's lungs through the user's mouth. An aerosol-generating article may resemble a conventional smoking article, such as a cigarette. An aerosol-generating article may be disposable. An aerosol-generating article may be partially-reusable and may comprise a replenishable or replaceable aerosol-forming substrate.

As used herein, 'aerosol-generating device' relates to a device that interacts with an aerosol-forming substrate to generate an aerosol. An aerosol-generating device may comprise one or more components used to supply energy from a power supply to an aerosol-generating means to interact with an aerosol-forming substrate to generate an aerosol that is inhalable by a user. The power supply may be an external power supply or may form part of the device, such as an on-board battery. The aerosol-generating means may be any suitable means for generating an aerosol from an aerosol-forming substrate. For example, the aerosol-generating means may be an electric heater.

The aerosol-generating device may comprise aerosol-generating means. The aerosol-generating means may be any suitable aerosol-generating means. For example, the aerosol-generating means may comprise a heater configured to heat an aerosol-forming substrate received within the heating chamber of the device. The heater may be configured to heat the aerosol-forming substrate to generate an aerosol for inhalation by a user. The heater may be any suitable type of heater.

The heater may extend into the heating chamber. The heater may extend into the heating chamber through the base. The heater may be arranged centrally within the heating chamber and may extend through a central portion of the base. Heaters extending into the heating chamber may be arranged to penetrate aerosol-forming substrate received in the heating chamber. A heater of this sort may be referred to as an internal heater. As used herein, 'internal heater' relates to a heater that is configured to be inserted into an aerosol-forming substrate when the aerosol-forming substrate is received in the heating chamber. Internal heaters may be inserted into the aerosol-forming substrate in order to directly contact the aerosol-forming substrate within the aerosol-generating article. An internal heater is configured to heat an aerosol-forming substrate of an aerosol-generating article from within. The use of an internal heater may be advantageous because it may be in direct contact with the aerosol-forming substrate in order to efficiently heat the substrate. The inner portion of the base may be a relatively flat or planar portion. The inner portion of the base is located radially inward of the peripheral portion of the base.

In embodiments comprising a heater extending into the heating chamber through the base, the base may be contoured to provide a chamfered intersection or a filleted intersection between the base and at least one surface of the heater. This configuration effectively fills in the intersection between the base and one or more surfaces of the heater as the heater projects outwards from the base. If the heater extends through the base into the heating chamber substantially perpendicularly to the base, the intersections between surfaces of the heater and the base have an angle of 90°. If the heater extends through the base at an angle other than 90°, the intersections between surfaces of the heater and the base may vary between sides of the heater, and on one side at least there will be an acute angle between the heater and the base. In both of these configurations, debris that accumulates in the intersections will be difficult to clean with a cleaning tool, such as a brush. Providing a chamfer or fillet at the intersections fills in the sharp angle. The angles of the chamfered or filleted intersection may be relatively open, so they are easy to access with a cleaning tool, such as a brush, in order to be cleaned. In other words, a brush can more easily access the chamfered or filleted intersections to dislodge accumulated debris.

The heater may extend into the heating chamber in a direction substantially parallel to the side wall. The heater may extend substantially parallel to a longitudinal axis of a tubular or cylindrical heating chamber. The heater may extend along a portion of the length of the heating chamber. In some embodiments, the heater may extend substantially the full length of the heating chamber. When an aerosol-forming substrate is inserted into the heating chamber, the heater may be arranged to be in direct contact with a large proportion of the aerosol-forming substrate. As used herein, 'length' refers to the maximum longitudinal dimension of the device, the substrate or a portion or part of the device or the substrate, such as the distance between the second end of the heating chamber and the first end of the heating chamber (i.e. the distance between the base and the opening).

The heater may be located centrally in the heating chamber. In other words, the heater may extend substantially along the central longitudinal axis of the heating chamber. In this configuration the highest temperature generated within the heating chamber, at the heater, may be generated along the central longitudinal axis of the heating chamber. In this configuration, the heater may be arranged to heat aerosol-forming substrate within the heating chamber from a central region outwards, heating all sides of the aerosol-forming substrate evenly. The heater may be arranged substantially at an equal distance from the side wall of the heating chamber, on all sides.

In some embodiments, the heater may extend into the heating chamber substantially perpendicularly to the side wall. In such a configuration the heater may extend in a transverse direction across an elongate heating chamber. As used herein, the term 'transverse' relates to a direction perpendicular to the longitudinal dimension of the device, the substrate or a portion or a part of the device or the substrate, such as a direction perpendicular to the longitudinal axis of the heating chamber.

The heater may be an external heater. As used here, 'external heater' refers to a heater that does not penetrate an aerosol-forming substrate in the heating chamber or any part of an aerosol-generating article received in the heating chamber. An external heater may be positioned at or around an inner surface of the heating chamber. In some embodiments, an external heater may contact the outer surface of an aerosol-generating article received in the heating chamber. In some embodiments, an external heater may not directly or physically contact an aerosol-forming substrate or any part of an aerosol-generating article received in the heating chamber. An external heater may be positioned within the aerosol-generating device but outside of or external to the heating chamber. A heating chamber with an external heater may be referred to as an oven and the external heater may be referred to as an oven heater.

The heater may be any suitable type of heater. For example, the heater may be an electrically resistive heating element. Such a heating element may be connected directly to a power supply of the device and electrical current from a power supply of the device may be converted directly into heat at the resistive heating element. This type of heater may minimise the number of parts required within the device.

The heater may be part of a heating assembly. The heating assembly may be any suitable type of heating assembly. For example, the heating assembly may be an electric heating assembly. Where the heating assembly is an electric heating assembly, the aerosol-generating device may also comprise a power supply for providing power to the heating assembly.

It will be appreciated that there are many heating assemblies that may be used. For example, the heating assembly may comprise a heater in the form of a susceptor element extending into the heating chamber and the heating assembly may further comprises an inductor arranged at or around the heating chamber that is configured to heat the susceptor. For example, the inductor may comprise a coil arranged outside the heating chamber or surrounding the heating chamber that acts to induce heating currents in the susceptor.

Particular embodiments will now be discussed in detail and shown by way of example only in the following Figures, in which.

Figure 3A:
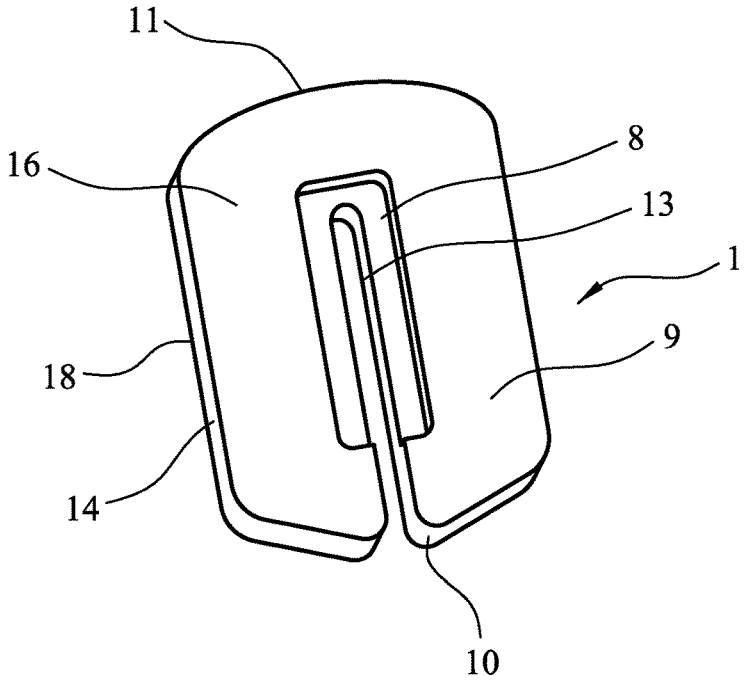
Figure 3B:
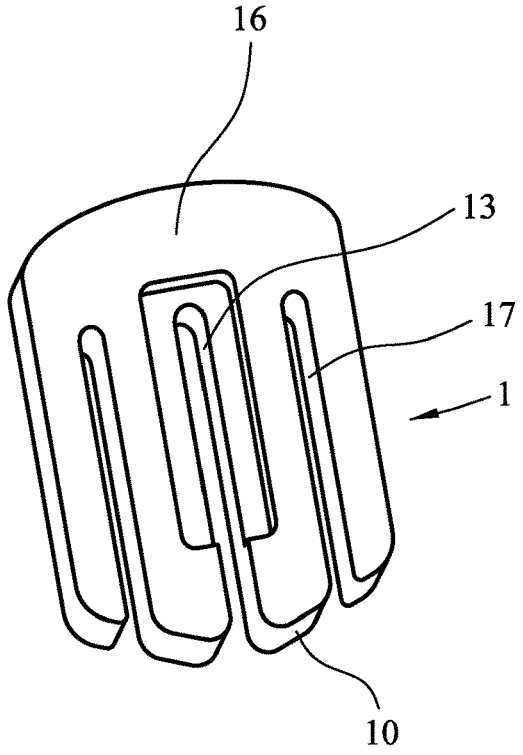
Figure 3C:
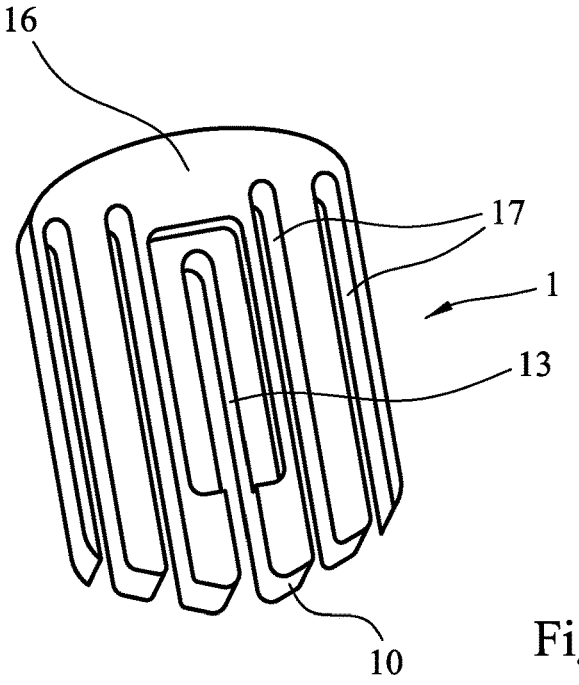
Figure 3D:
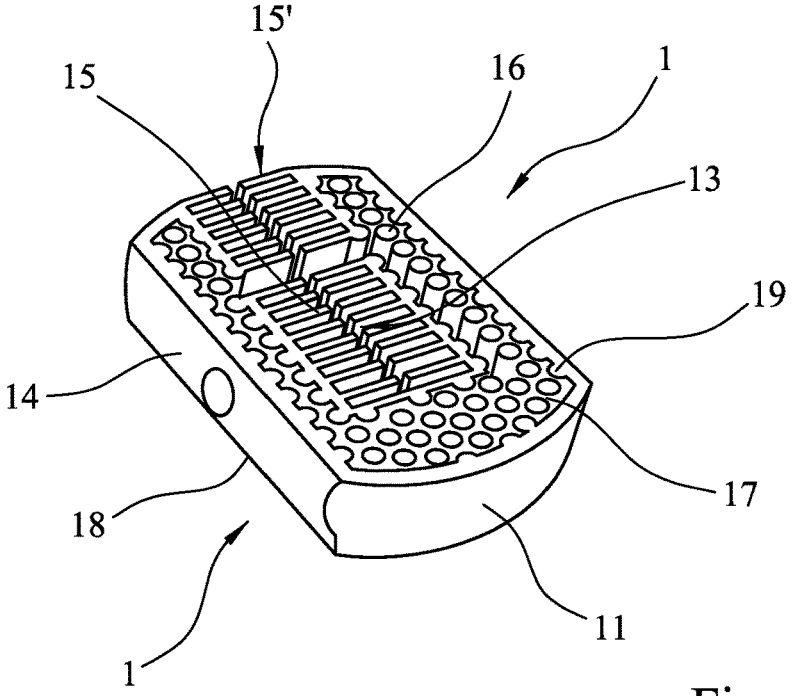
Figure 4:
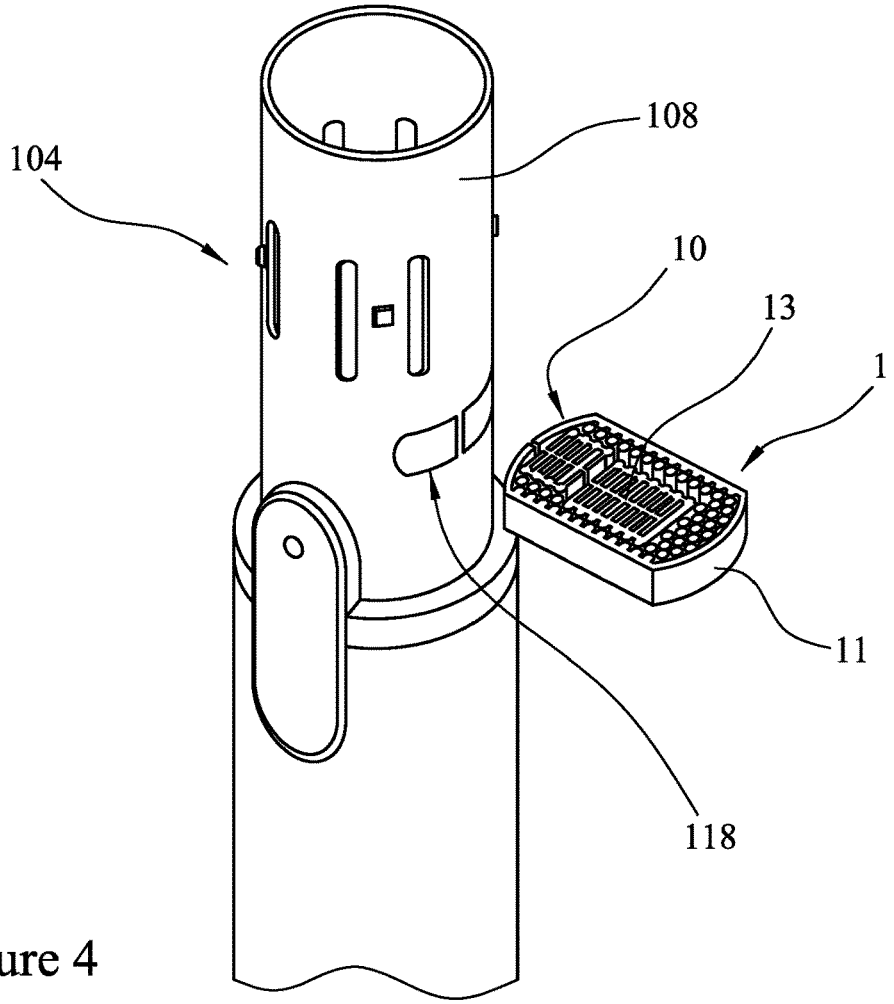
Figure 5A:
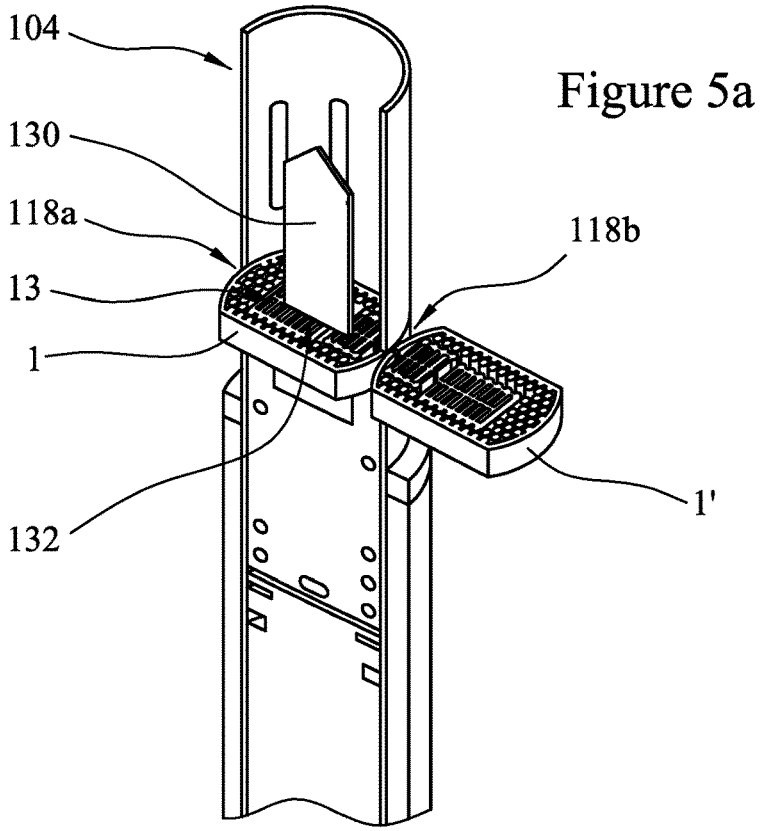
Figure 5B:
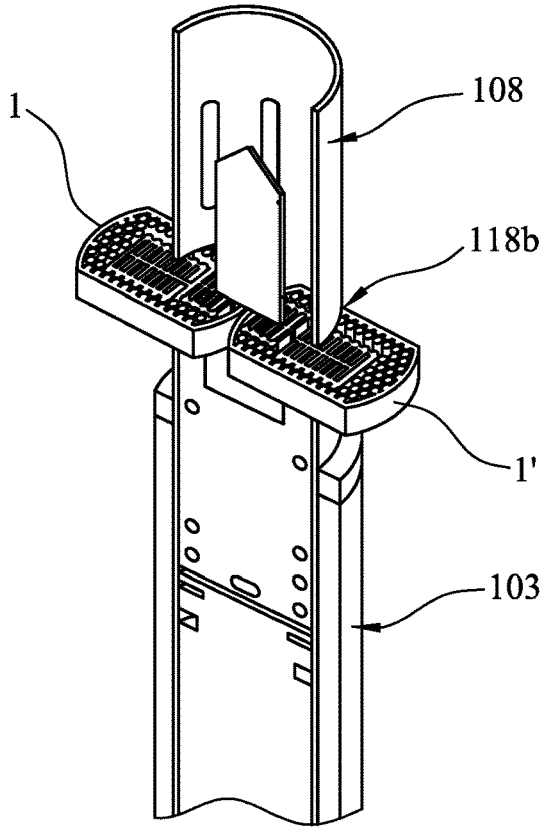
Figure 5C:
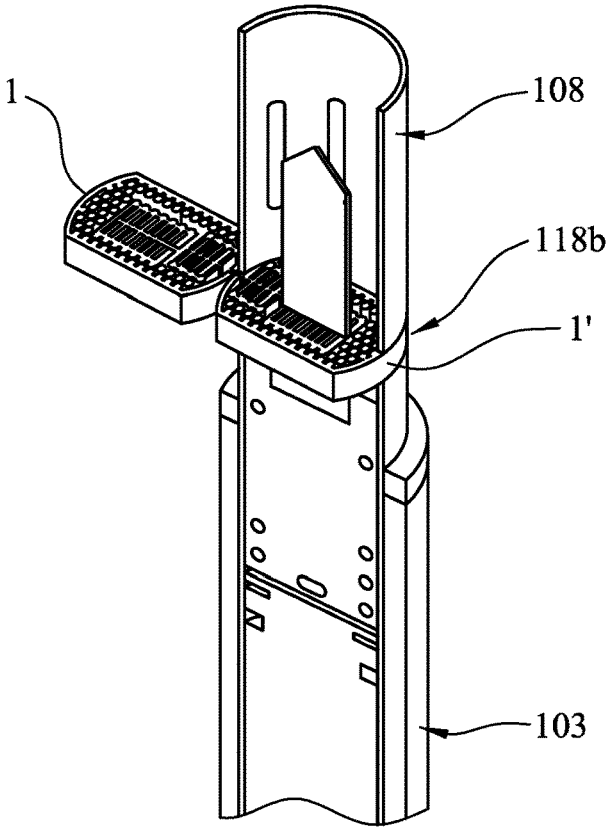

FIG. 3*a* shows a first embodiment of a residue collector according to the present invention;

FIG. 3*b* shows a second embodiment of a residue collector according to the present invention;

FIG. 3*c* shows a third embodiment of a residue collector according to the present invention;

FIG. 3*d* shows a fourth embodiment of a residue collector according to the present invention;

FIG. 4 is a perspective view of an aerosol-generating system according to a first aspect of the present invention;

FIGS. 5*a* to 5*c* show a cut-through perspective view of an aerosol-generating system according to a second embodiment of the present invention.

Figure 1:
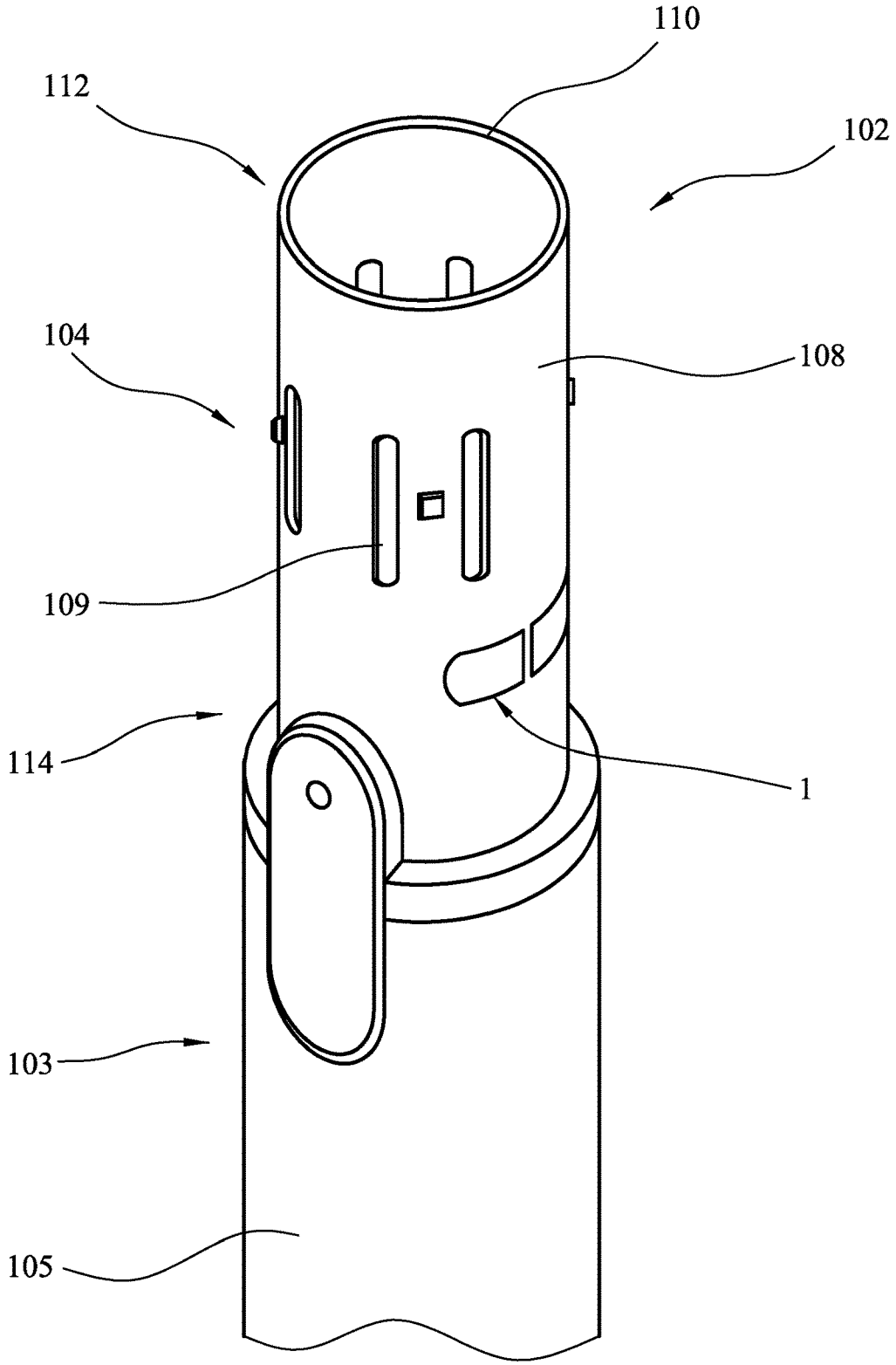
FIG. 1 shows a perspective view of an aerosol-generating device according to an embodiment of the present invention.
Figure 2:
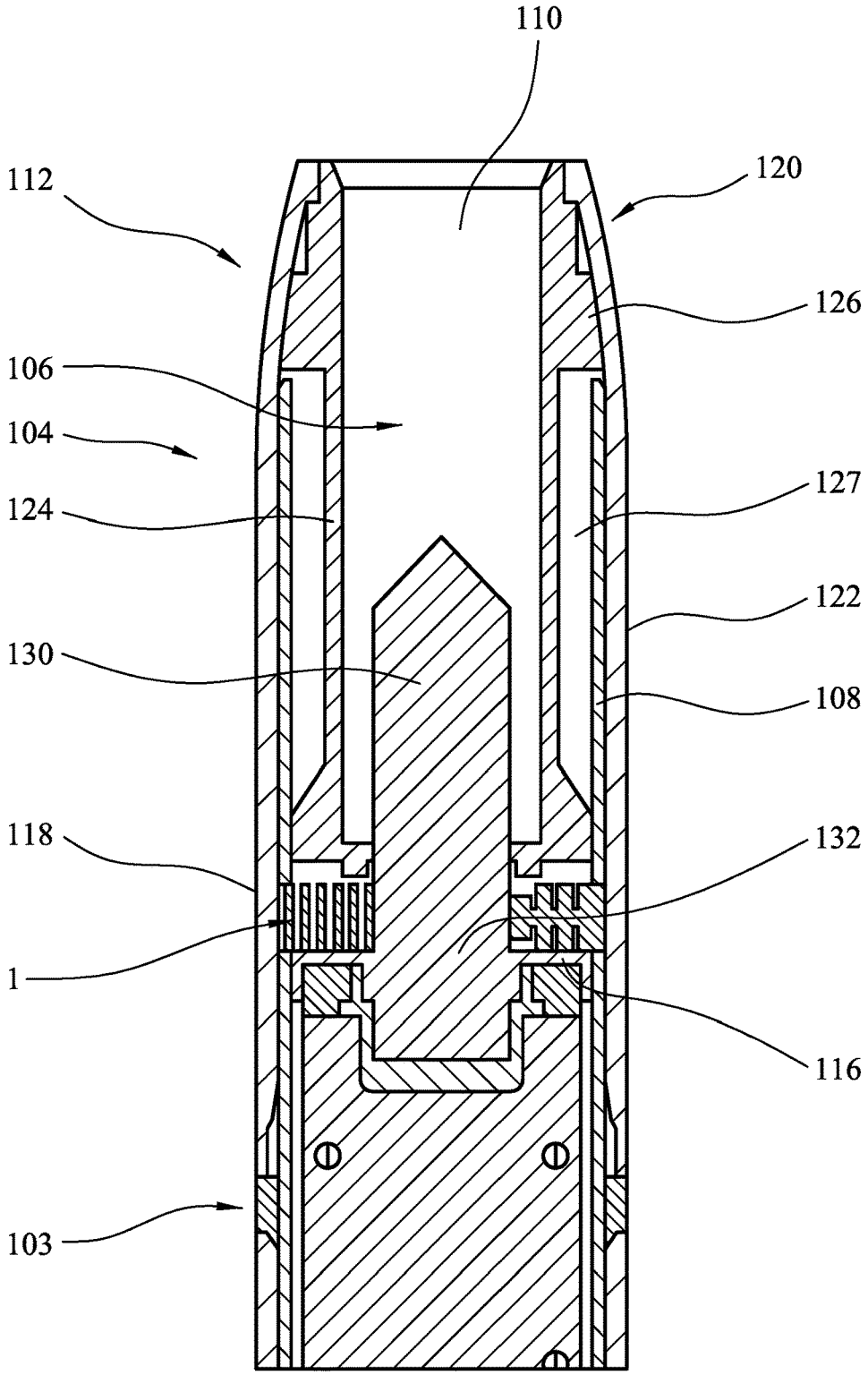
FIG. 2 shows a cut-through view of an aerosol-generating system according to the present invention.

FIGS. 1 and 2 show an aerosol-generating device 102 of an aerosol-generating system according to an embodiment of the present invention. The device 102 is generally elongate and cylindrical and comprises a main body portion 103 at a first end and a heating portion 104 at a second end, opposite the first end. The main body portion 103 includes an outer housing 105, which houses a power supply, control apparatus and charging port (not shown). The heating portion 104 includes a generally cylindrical heating chamber 106, which is generally defined by a cylindrical side wall 108 projecting from one end of the main body portion 103, coaxial to the main body. The heating chamber 106 comprises an opening 110 at a first end 112, distal to the main body 103, and is closed at a second end 114, opposite the first end 112, by a base 116 positioned at the main body portion 103. The heating portion 104 further includes an extractor 120 removably positionable over the cylindrical side wall 108. FIG. 1 shows a perspective view of the aerosol-generating device 102 partly disassembled with the extractor 120 removed. FIG. 2 shows a cut-through view of the aerosol-generating device 102 fully assembled with the extractor 120 received over the heating chamber 106.

As shown in FIG. 1, the cylindrical side wall 108 defines a plurality of vents 109 extending through the side wall 108. The vents 109 are configured to enable air to enter the heating chamber 106 from the outside. Each vent 109 is generally elongate and extends substantially parallel to the central axis of the heating chamber 106. The vents 109 are spaced evenly around the circumference of the side wall 108 at a substantially centrally between the first end 112 and the second end 116.

The cylindrical side wall 108 further defines a side opening 118 at the second end of the heating chamber 106, which will be described in more detail later on.

As shown in FIG. 2, a heater 130 extends into the heating chamber 106 through the base 116 at the closed second end 114. The heater 130 comprises a resistive heating element (not shown) that is connected to the power supply and control unit in the main body portion 103 of the device 102. The heater 130 is configured as an internal heater for penetrating into an aerosol-forming substrate received in the heating chamber 106. The heater 130 is in the form of an elongate, planar, heating blade terminating at a tapered end or a point at the end distal to the base 116. The heater 130 extends into the heating chamber 106 in a direction substantially parallel with the cylindrical side wall 108. The heater 130 is arranged centrally within the heating chamber 106, such that the heater 130 is substantially aligned with the central longitudinal axis of the heating chamber 106. The heater 130 is elongate, which means that the heater 130 has a length dimension that is greater than its width dimension and its thickness dimension. The heater 130 is also thin, which means its thickness dimension is substantially less than its length dimension and its width dimension. First and second opposing faces of the heater 130 are defined by the length and the width of the heater 130. In this embodiment, the length of the heater 130 is about half the length of the cylindrical side wall 108. In other words, the heater 130 extends about half way into the heating chamber 106. Since the heater 130 extends only partially the length of the heating chamber 106, the cylindrical side wall 108 provides some protection to the heater 130 by preventing access to the heater 130 from the side. It will be appreciated that in other embodiments, the heater 130 may extend into the heating chamber 106 by different amounts, for example, the heater 130 may extend about three quarter of the way into the heating chamber or may extend substantially the entire length of the heating chamber.

As shown in FIGS. 1 and 2, the extractor 120 is removably receivable over the cylindrical side wall 108. The extractor 120 comprises an outer sleeve 122 and a sliding receptacle 124 received in the outer sleeve 122.

The outer sleeve 122 is generally in the form of a cylindrical tube that is open at both ends. The outer sleeve 122 has an external diameter that is substantially the same as the diameter of the housing 105 of the main body portion 103, such that the outer sleeve 122 and the housing 105 of the main body portion 103 form a substantially continuous cylindrical shape when the extractor 120 is received on the cylindrical side wall 108.

The sliding receptacle 124 is generally in the form of a cylindrical tube that is open at a first end and substantially closed at a second end, opposite the first end. The sliding receptacle 124 defines a chamber for receiving aerosol-forming substrate. The second end of the sliding receptacle 124 is substantially closed except for a central opening 125 that is configured to receive the heater 130 when the extractor 120 is received on the side wall 108. The central opening 125 of the second end of the sliding receptacle 124 is slightly larger than the heater 130 such that an air gap is provided between the second end of the sliding receptacle and the heater 130 when the extractor 120 is received over the cylindrical side wall 108. A flange 126 protrudes outwards from the sliding receptacle 124 at the open end. The sliding receptacle 124 is received in the outer sleeve 122 and secured to the outer sleeve 122 at the flange 126 at the first end.

The sliding receptacle 124 has an outer diameter that is smaller than the inner diameter of the outer sleeve 122, such that an annular gap 127 is provided between the outer sleeve 122 and the sliding receptacle 124. The annular gap 127 is sized and configured to receive the cylindrical outer wall 108. The outer diameter of the sliding receptacle 124 is slightly smaller than the inner diameter of the cylindrical side wall 108, such that the sliding receptacle 124 may be easily received in the heating chamber 106. The inner diameter of the outer sleeve 122 is slightly larger than the outer diameter of the cylindrical side wall 108, such that an air gap is formed between the outer sleeve 122 and the cylindrical side wall 108 when the extractor 120 is received over the cylindrical side wall 108. The flange 126 provides a stop against which the outer end of the cylindrical side wall 108 abuts when the extractor 120 is fully received over the cylindrical side wall 108.

In FIG. 2, the extractor 120 is shown in a first position, or an operating position, where the extractor is fully received over the cylindrical side wall 108. In this position, the cylindrical side wall 108 is fully received in the annular gap 127, with the end of the side wall 108 abutting the flange 126 of the extractor 120.

The first open end of the outer sleeve 122 and the open end of the sliding receptacle 124 are arranged substantially flush with each other. However, the length of the outer sleeve 122 is greater than the length of the sliding receptacle 124. As shown in FIG. 2, the outer sleeve 122 has a length sufficient to abut the housing 105 of the main body portion 103 when the extractor 120 is in the operating position. The sliding receptacle 124 has a length sufficient to provide a space between the base 114 of the heating chamber 106 and the substantially closed second end of the sliding receptacle 124 when the extractor 120 is in the operating position. A base portion 132 of the heater 130 extends through the space. The heating element (not shown) of the heater 130 does not extend over the base portion 132 of the heater 130. The side opening 118 in the cylindrical side wall 108 is aligned with the space between the base 114 and the second end of the sliding receptacle 124.

Typically, an aerosol-generating article (not shown) that is suitable for use with the device 102 of FIGS. 1 and 2 is generally in the form of a conventional cigarette. The article comprises an aerosol-forming substrate, such as a rod of tobacco, at a distal end, and a filter at a proximal end, opposite the distal end. The article may have a width or diameter that is slightly smaller than the inner diameter of the sliding receptacle 124 of the extractor 120, such that the article may be easily inserted into the chamber of the sliding receptacle 124 and removed from the chamber of the sliding receptacle 124. The aerosol-forming substrate may have a length that is substantially similar to or slightly larger than the length of the portion of the heater 130 between the base portion 132 and the tapered end (i.e. the portion of the heater 130 that extends into the chamber of the sliding receptacle 124 when the extractor 120 is in the first position). This sizing enables the heater 130 to extend through substantially the entire length of the aerosol-forming substrate when the aerosol-generating article is receive in the heating chamber 106 of the device 102.

In use, when the extractor 120 received over the heating chamber 106 in the first (operating) position, the aerosol-generating article (not shown) may be inserted into the heating chamber 106 of the device 102 through the open end of the sliding receptacle 124 of the extractor 120. As the article is inserted into the heating chamber 106, the tapered end of the heater 130 encounters the aerosol-forming substrate at the distal end of the article and pierces the substrate. The aerosol-generating article may be moved further into the heating chamber 106 until the distal end of the article abuts the substantially closed second end of the sliding receptacle 124. In this fully received position, the heater 130 extends into the aerosol-forming substrate along substantially the entire length of the aerosol-forming substrate.

When the device 102 is turned on, power is supplied to the heater 130 from the power supply (not shown) in the main body portion 103. The heater 130 heats the aerosol-forming substrate at the distal end of the aerosol-generating article and volatile substances are generated or evolved from the aerosol-forming substrate. When a user draws on the mouth end of the aerosol-generating article, air is drawn into the device 102 and through the aerosol-generating article, from the distal end to the mouth end, for inhalation by the user. Air is drawn into the device 102 through air inlets (not shown) in the outer wall 122 of the extractor 120 and is drawn into the heating chamber 106, into the space between the cylindrical side wall 108 and the outer surface of the sliding receptacle 124, through the vents 109 in the cylindrical side wall 108. Air between the cylindrical side wall 108 and the outer surface of the sliding receptacle 124 is drawn into the chamber of the sliding receptacle 124 through the air gap between the heater 130 and the closed second end of the sliding receptacle 124. The air entering the chamber of the sliding receptacle 124 is drawn into the aerosol-generating article through the distal end, such that the air encounters the aerosol-forming substrate that is being heated by the heater 130. The volatile substances evolved from the heated aerosol-forming substrate are entrained in the air entering the aerosol-generating article at the distal end, and are drawn with the air from the distal end of the article to the mouth end. As the volatile substances are drawn through the article, they condense to form an inhalable aerosol. The aerosol is drawn out of the article at the mouth end for inhalation by the user.

During insertion of the aerosol-generating article into the heating chamber 120 and during removal of the aerosol-generating article 120 from the heating chamber 120, loose debris may be released from the aerosol-forming substrate into the heating chamber 120. In particular, loose debris may be created around the heater 130 as the substrate is moved against the heater 130. The loose debris may accumulate at the closed second end 114 of the heating chamber 106. In particular, debris may accumulate in corners of the heating chamber 106 where the base 116 meets the heater 130.

As shown in FIGS. 1 and 2, a residue collector 1, according to an embodiment of the present invention, is removably disposed in the heating chamber 106 of the device 102. The residue collector 1 is positioned at the second end 114 of the heating chamber 106, supported on the base 116. Specifically, the residue collector 1 is positioned in the space between the base 114 and the substantially closed second end of the sliding receptacle 124. The residue collector 1 substantially surrounds or circumscribes the base portion 132 of the heater 130. In other words, the residue collector 1 substantially covers a portion of the base 116 around the heater 130. In this position, the residue collector is positioned at the position of the base 116 at which the majority of the loose debris released from aerosol-forming substrate accumulates. Accordingly, the residue collector 1 of the present invention is positioned to intercept debris before it reaches the base 116 of the heating chamber 106. Thus, the residue collector 1 may facilitate removal of the debris from the heating chamber 106.

The residue collector 1 has a rounded rectangular profile, having substantially planar sides and a front and rear end that are curved. The front and rear ends are curved with substantially the same curvature as the cylindrical side wall 108. The length of the planar sides is complimentary of the size of the base 114 of the heating chamber 106, such that the curved front and rear ends of the residue collector are flush with the cylindrical side wall 108 when the residue collector 1 is fully received in the heating chamber 106. The residue collector has a height or thickness between the first and second faces that is slightly smaller than the height of the space between the base 114 and the second end of the residue collector 124, such that the residue collector 1 extends substantially between the base 114 and the second end of the sliding receptacle 124 when the extractor 120 is received over the cylindrical side wall 108.

In this embodiment, the residue collector 1 is positioned in a space between the base 116 of the heating chamber 106 and the sliding receptacle 124 of the extractor 120. However, it will be appreciated that in other embodiments, the residue collector 1 may be positioned in the chamber of the sliding receptacle 124, between the substantially closed second end of the sliding receptacle 124 and an aerosol-forming substrate received in the chamber. In these embodiments, the sliding receptacle may extend to the base 114 of the heating chamber 106. In these embodiments, the outer sleeve 122 and the sliding receptacle may require side openings to facilitate insertion and removal of the residue collector. However, the cylindrical side wall 108 of the heating chamber 106 may not require a side opening 118. An advantage of adapting the extractor 120 to accept the residue collector may be that debris that would otherwise accumulate in the extractor may be easily removed with the residue collector 1.

The side opening 118 in the cylindrical side wall 108 of the device 102 is provided to facilitate insertion of the residue collector 1 into the heating chamber 106 and removal of the residue collector 1 from the heating chamber 106. Accordingly, the side opening 118 has a similar height and width to the residue collector 1, to enable the residue collector to be inserted into the heating chamber 106 through the side opening 118 and removed from the heating chamber 108 through the side opening 118. The side opening 118 is elongate and extends transverse to the central axis of the heating chamber 106. The side opening 108 has a width substantially equal to the width of the residue collector 1 and a height substantially equal to the height of the residue collector 1. The side opening 108 is positioned between the vents 109 and the closed second end of the heating chamber 106, at the space between the base 114 and the second end of the sliding receptacle 124 when the extractor 120 is received on the cylindrical side wall 108.

In this embodiment, the residue collector 1 does not have a substantially circular profile, and as such, the residue collector does not cover the entire base 114 when the residue collector 1 is fully received in the heating chamber 106. Peripheral portions of the base 114 at either side of the side opening 118 are not covered by the residue collector. These uncovered peripheral portions of the base are unlikely to accumulate residue from aerosol-forming substrate in the heating chamber 106, as these portions of the base are directly below closed portions of the sliding receptacle 124. In some embodiments, the residue collector may have a profile substantially similar to that of the heating chamber and the residue collector may substantially cover the entire base. However, in these embodiments, the side opening of the side wall of the heating chamber may be required to extend the entire width of the heating chamber in order to enable insertion and removal of the residue collectors. It may not be necessary to increase the size of the side opening in embodiments where the residue collector is compressible to reduce the width of the residue collector on insertion and removal.

FIGS. 3*a-d* show specific embodiments of residue collectors in accordance with the present invention.

FIG. 3*a* shows a first embodiment of the residue collector 1. The residue collector 1 comprises a body defined between a first face 16 and a second face 18. A side wall 14 extends between the first face 16 and the second face 18, defining the periphery of the residue collector 1. The residue collector 1 has a substantially rounded rectangular transverse cross section, such that the residue collector 1 generally has an elongate shape with planar sides and a rounded ends. In this embodiment, one of the rounded ends may be considered to be a front end 10 and the opposite rounded end may be considered to be a rear end 11.

In the embodiment of FIG. 3*a*, the residue collector 1 defines a slot 13 extending between the first face 16 and the second face 18, such that the slot is open at the first face 16 and the second face 18. The slot 13 is an elongate opening through the body of the residue collector 1. The slot 13 extends from the side wall 14 at the front end 10 of the residue collector 1 towards a central portion of the residue collector 1. In other words, the slot 13 is open at the front end 10. Additionally, the residue collector 1 includes a lip 9 projecting around the edge of the first face 16. The lip 9 projects upwards, away from the first face 16, and defines a recessed portion or open cavity 8 around the slot 13. In this embodiment, the lip 9 is wide, extending across a large proportion of the first face 16. Accordingly, the open cavity 8 is a narrow recessed portion. When the residue collector is fully received in the heating chamber, the open cavity 8 is arranged directly below the opening in the second end of the sliding receptacle 124. The open cavity 8 has a similar size to the opening in the second end of the sliding receptacle, so that the majority of debris falling through the opening may be received in the open cavity 8.

To prepare the device 102 for use, before the extractor 120 is received over the cylindrical side wall 108, the residue collector 1 is inserted into the heating chamber 106 of the device 102 through the side opening 118 in the cylindrical side wall 108, as shown in FIG. 4. The front 10 of the residue collector 1 is inserted into the side opening 118, and the slot 13 receives the base portion 132 of the heater 130. When the residue collector 1 is fully inserted into the heating chamber 106, the heater 130 abuts the end of the slot 13, the front 10 abuts the cylindrical side wall 108, the rear 11 is positioned flush with the cylindrical side wall 108 and the second face 18 is supported on the base 114 of the heating chamber 106, as shown in FIG. 2. Since the rear 11 of the residue collector 1 is flush with the cylindrical side wall 108, the outer sleeve 122 of the side wall may slide over the side opening 118, past the residue collector 1, without contacting the residue collector 1. During use of the device 102, debris that falls from an aerosol-generating article inserted into the heating chamber 106 collects on the first face 16 of the residue collector 1. Debris that accumulates in the recessed portion 8 may be retained by the lip 9, particularly during removal of the residue collector 1 from the device 102. Removal of the residue collector 1 from the heating chamber 106 may be performed after the extractor 120 and the article have been removed from the heating chamber 106.

A second embodiment of a residue collector 1 according to the present invention is shown in FIG. 3*b*. In the second embodiment, the residue collector 1 has substantially the same shape as the first embodiment of the residue collector 1 shown in FIG. 3*a*; however the residue collector 1 of shown in FIG. 3*b* defines two additional elongate slits 17. The elongate slits 17 extend between the first face 16 and the second face 18 of the residue collector 1, similar to the slot 13. The elongate slits 17 are positioned both sides of the slot 13, and extend substantially parallel to the slot 13. The elongate slits 17 extend from the front 10 of the residue collector 1. The elongate slits 17 are not configured to receive a heater of the aerosol-generating device, but rather are configured to enable the width of the residue collector 1 to be compressed to facilitate insertion and removal.

During insertion of the residue collector 1 into the heating chamber 106, an inward force can be applied to the side walls 14 on both sides of the residue collector 1, between the front 10 and rear 11 of the residue collector 1. When such an inward force is applied, the sides of each elongate slit 17 may be brought together such that the width of the residue collector is reduced. Reducing the width of the residue collector 1 may allow the residue collector 1 to be more easily inserted into the side opening 118 of the device 102.

A third embodiment of the residue collector 1 according to the present invention is shown in FIG. 3*c*. The residue collector 1 shown in FIG. 3*c* is substantially similar to the second embodiment of the residue collector 1 shown in FIG. 3*b*, however, the residue collector 1 shown in FIG. 3*c* comprises four elongate slits 17, two slits at either side of the slot 13. The two additional elongate slits 17 may allow the width of the residue collector 1 to be compressed even further.

A fourth embodiment of the residue collector 1 according to the present invention is shown in FIG. 3*d*. The residue collector 1 shown in FIG. 3*d* is has a substantially similar transverse cross-sectional shape to first embodiment of the residue collector 1 shown in FIG. 3*a*. However the residue collector 1 shown in FIG. 3*d* has several different features to the first embodiment of the residue collector 1.

The lip 9 of the residue collector 1 shown in FIG. 3*d* is narrow and extends around the periphery of the residue collector 1. The lip 9 extends upwards from the first face 16 of the residue collector 1 and with the first face 16 of the residue collector 1 defines an open cavity 19. A plurality of projections 17 also extend upwards from the first face 16 within the open cavity 19. The upward projections 17 are regularly spaced across the open cavity 19 in a regular pattern, such that the spaces between the projections 17 in the cavity 19 form orifices in a honeycomb pattern. The upward projections 17 and the lip 9 extend substantially the same distance from the first face 16, and as such the ends of the lip 9 and the projections 17 generally lie on a plane.

In use, debris that accumulates on the residue collector 1 may fall into the cavity 19, between the upward projections 17, onto the first face 16. During removal of the residue collector 1, the debris collected by the residue collector 1 may be trapped in the cavity 19, which may substantially prevent debris from being dislodged from the residue collector 1 and falling into the heating chamber 106 during removal of the residue collector 1 from the heating chamber 106.

The slot 13 of the residue collector 1 of FIG. 3*d* also comprises cut-outs 15 on both sides of the slot 13. The cut outs 15 extend from the slot 13 towards the side walls 14 of the residue collector 1. The cut-outs 15 extend between the first face 16 and the second face 18, similarly to the slot 13. However, it will be appreciated that in some embodiments the cut-outs 15 may only extend partially from the first face 16 towards the second face 18. The areas between the cut-outs 15 define a comb like structure, with each area comprising a projecting elements 15' extending from the body of the residue collector inwards towards the central axis of the slot 13.

When the residue collector 1 shown in FIG. 3*d* is inserted into the heating chamber 106 of the device 102, the ends of the projecting elements 15' abut the base portion 132 of the heater 130. As such, during removal of the reside collector 1 from the heating chamber 106, the ends of the projecting elements 15' are drawn against the base portion 132 of the heater 130. This allows the projecting elements 15' to wipe clean residue from the base portion 132 of heater 130 during removal. The projecting elements 15' may deform when the residue collector 1 is inserted into the heating chamber 106. As such, the projecting elements 15' are generally configured to be resiliently deformable, such that they are not damaged during insertion and removal.

In all of the above embodiments, the residue collector 1 has a substantial thickness. However, it will be appreciated that in some embodiments, the residue collector may be a thin plate or sheet. Where the residue collector is a thin plate or sheet, the rigidity of the residue collector may be required to be increased, so that the residue collector does not deform or break during insertion and removal.

Another embodiment of the aerosol-generating device 102 is shown in FIGS. 5*a-c*. The device 102 shown in FIGS.

5*a-c* is substantially identical to the device 102 shown in FIGS. 1 and 2; and like references numerals are used to indicate like features. However, the device 102 shown in FIGS. 5*a-c* comprises two opposing side openings 118*a*, 118*b* in the cylindrical side wall 108. For the sake of clarity, the extractor 120 is not shown in FIGS. 5*a-c*. The two opposing side openings 118*a*, 118*b* enable a residue collector 1 to be inserted and removed from either side of the device 102. In particular, a first residue collector 1 positioned within the heating chamber 106, which was inserted through the first side opening 118*a*, may be removed from the heating chamber 106 through the first side opening 118*a* by being pushed back out of the first side opening 118*a* by a second residue collector 1' being inserted through the second side opening 118*b*. Such a replacement process is shown in FIGS. 5*a-c*.

In more detail, to remove a first residue collector 1 from the heating chamber 106 of the device 102 of FIGS. 5*a-c*, the front 10' of the new second residue collector 1' may be positioned to abut the front 10 of the used residue collector 1 at the second opening 118*b*, as shown in FIG. 5*a*. As the second residue collector 1' is moved through the second side opening 118*b*, into the heating chamber 106, the first residue collector 1 may be pushed out of the heating chamber 106 through the first side opening 118*a*, as shown in FIGS. 5*b* and 5*c*. Accordingly, insertion and removal can be combined into a single act.

In both of the above embodiments, the aerosol-generating device comprises an extractor. However, it will be appreciated that in some embodiments of the invention, the aerosol-generating device may not comprise such an extractor. In these embodiments, the residue collector may be positionable at or towards the second end of the heating chamber and sized such that the residue collector does not interfere with the aerosol-generating process.

The invention claimed is:

1. An aerosol-generating system, comprising:

an aerosol-generating device having a heating chamber configured to heat an aerosol-forming substrate, the heating chamber comprising a first end having an opening, a second end having a base, and at least one side wall extending around the heating chamber between the opening and the base and around a circumference of the base; and a residue collector removably insertable into the heating chamber and positionable at closer proximity to the second end than the first end, wherein the heating chamber further comprises a first side opening in the at least one side wall and a second side opening in the at least one side wall, opposite the first side opening, and wherein the residue collector is insertable into the heating chamber and removable from the heating chamber through the first and the second side openings.

2. The aerosol-generating system according to claim 1, wherein the residue collector is positionable between the base of the heating chamber and the aerosol-forming substrate when the aerosol-forming substrate is received in the heating chamber.

3. The aerosol-generating system according to claim 1, wherein the residue collector comprises a body having a first face, a second face, and a side wall extending between the first face and the second face, and wherein, when the residue collector is positioned within the heating chamber, the second face is positioned adjacent the base of the heating chamber.

4. The aerosol-generating system according to claim 3, wherein a lip projects from the first face of the residue collector around a periphery of the first face such that an open cavity is defined by the first face and the lip.

5. The aerosol-generating system according to claim 4, wherein a plurality of projections project from the first face of the residue collector into the cavity defined by the first face and the lip.

6. The aerosol-generating system according to claim 3, wherein the residue collector further comprises one or more slits extending between the first face and the second face.

7. The aerosol-generating system according to claim 3, wherein the residue collector is provided as part of an array of residue collectors, and wherein adjacent residue collectors in the array are releasably secured together at the side walls of the adjacent residue collectors.

8. The aerosol-generating system according to claim 1, further comprising a heating assembly and a power supply configured to supply power to the heating assembly.

9. The aerosol-generating system according to claim 8, wherein the heating assembly comprises a heater that projects into the heating chamber through the base.

10. The aerosol-generating system according to claim 9, wherein the residue collector comprises a slot extending between the first face and the second face, and wherein the slot is configured to receive the heater when the residue collector is positioned in the heating chamber.

11. The aerosol-generating system according to claim 10, wherein the slot extends to a side wall of the residue collector such that the heater is configured to be received in the slot through the side wall.

12. The aerosol-generating system according to claim 11, wherein the residue collector further comprises a plurality of cut-outs on opposite sides of the slot.

* * * * *